United States Patent [19]

Caprio et al.

[11] Patent Number: 4,740,015

[45] Date of Patent: Apr. 26, 1988

[54] SECURITY DOCUMENT AND METHOD OF TESTING SAME

[75] Inventors: Richard D. Caprio, Niagara Falls; Roland L. Engle, Williamsville, both of N.Y.

[73] Assignee: Moore Business Forms, Inc., Grand Island, N.Y.

[21] Appl. No.: 880,833

[22] Filed: Jul. 1, 1986

[51] Int. Cl.[4] ..... B42D 15/00; B41L 1/16; B05D 1/32; G09F 3/00

[52] U.S. Cl. ..... 283/70; 282/27 A; 427/259; 428/916

[58] Field of Search ..... 283/70, 72, 74, 95, 283/96, 113, 114; 346/200, 206; 282/27, 5; 487/146, 259; 428/916, 918, 195

[56] References Cited

U.S. PATENT DOCUMENTS

| | | | |
|---|---|---|---|
| 1,567,156 | 12/1925 | Lohff . | |
| 2,396,833 | 3/1946 | D'Humy . | |
| 2,618,574 | 11/1952 | Pavlic | 283/72 |
| 3,227,474 | 1/1966 | Hoeflinger | 283/72 |
| 3,248,808 | 5/1966 | Daker et al. | 283/72 |
| 4,165,101 | 8/1979 | Sternberg . | |
| 4,360,548 | 11/1982 | Skees et al. | 283/72 |
| 4,397,483 | 8/1983 | Hiraishi et al. . | |
| 4,496,961 | 1/1985 | Devrient | 283/72 |

*Primary Examiner*—E. R. Kazenske
*Assistant Examiner*—Paul M. Heyrana, Sr.
*Attorney, Agent, or Firm*—Cushman, Darby & Cushman

[57] ABSTRACT

A security document having first and second areas on one side coated or treated with complementary compositions of the types that will leave a mark when pressed together, with some areas of one composition desensitized, so that the authenticity of the document may be tested by folding the document to place the areas together and then exerting pressure thereon.

5 Claims, 1 Drawing Sheet

SECURITY DOCUMENT AND METHOD OF TESTING SAME

BACKGROUND OF INVENTION

This invention relates to documents that cannot readily be copied and the copies passed off as valid.

Particularly with the advent of photocopying machines that can make seemingly valid copies of documents, and may do so in colors, the need has become acute for original documents that either cannot be faithfully copied, or cannot in any event be copied and the copies passed off as valid documents. The object of the present invention is one solution to the problem.

SUMMARY OF THE INVENTION

In accordance with the present invention a sheet of material such as paper is treated or coated on one of its sides to that a first area of the side comprises a first composition and a second area comprises a second composition. At some point in the preparation of the document printing and/or other imaging may be placed on one or both sides of the document.

The compositions are of the complementary types that make up so-called "carbonless copying" materials, typically one of them being of the encapsulated variety. Pressure on the capsules ruptures them, to release a fluid. Rupture of the capsules not in the presence of the complementary material leaves no mark. However, when the capsules are in contact with the complementary material and pressure applied, the fluids mix and a mark results. Sometimes capsules are not used, and the material is simply applied to the material directly. In practice of the present invention the two areas with complementary compositions thereon are brought together (one laid over the other) as by folding the document. Then a test may be made by applying pressure, for example, by use of the end of a paperclip or any other commonplace and usually available object. If a mark results, the person testing the document knows that it is a valid one.

A further feature of the invention is that some portion of at least one of the areas is treated so as to desensitize the mark-forming composition. Then, when the testing mark is made, it will not produce a mark in the desensitized portion. This further assures the testing person that the document is valid. This feature thwarts the counterfeiter who knew to use the compositions, but did not know of the desensitization feature.

An illustrative embodiment of the invention will next be described, with reference to the accompanying drawings.

DETAILED DESCRIPTION OF PREFERRED EMBODIMENT

Figure 1:
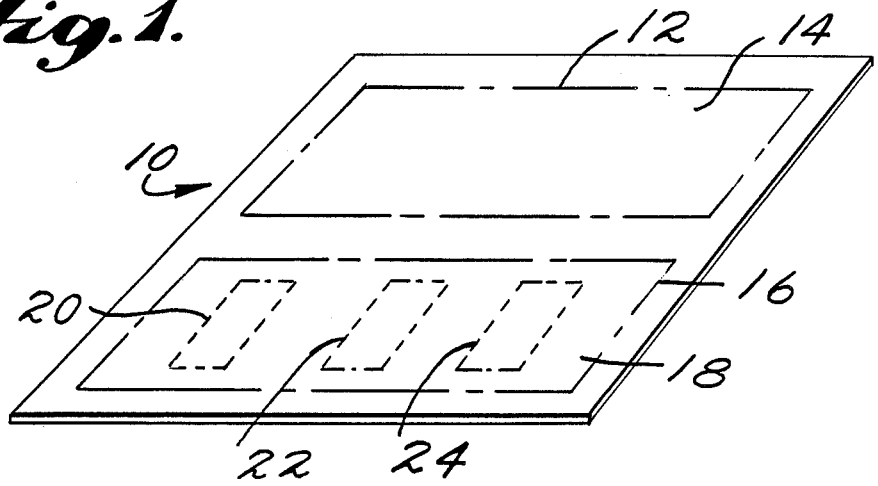
FIG. 1 shows a sheet of paper or the like prepared according to the invention.

In FIG. 1 reference character 10 indicates a sheet of paper or like material, which may be a valuable document, for example, an automobile title. The title particulars, not shown in FIG. 1, may be on the underneath side but could be on the top side or both sides. Chain line 12 designates the boundary of a first area 14 which is coated with a first composition, for example, capsules which contain a marking fluid. Chain line 16 designates the boundary of a second area 18 which is coated with a second composition, for example, the usual clay or resin known in "carbonless copying", which is the complement to the capsules of the first area. Dash lines 20, 22 and 24 designate areas where the composition of the area 18 has been desensitized in a manner described below.

Figure 2:
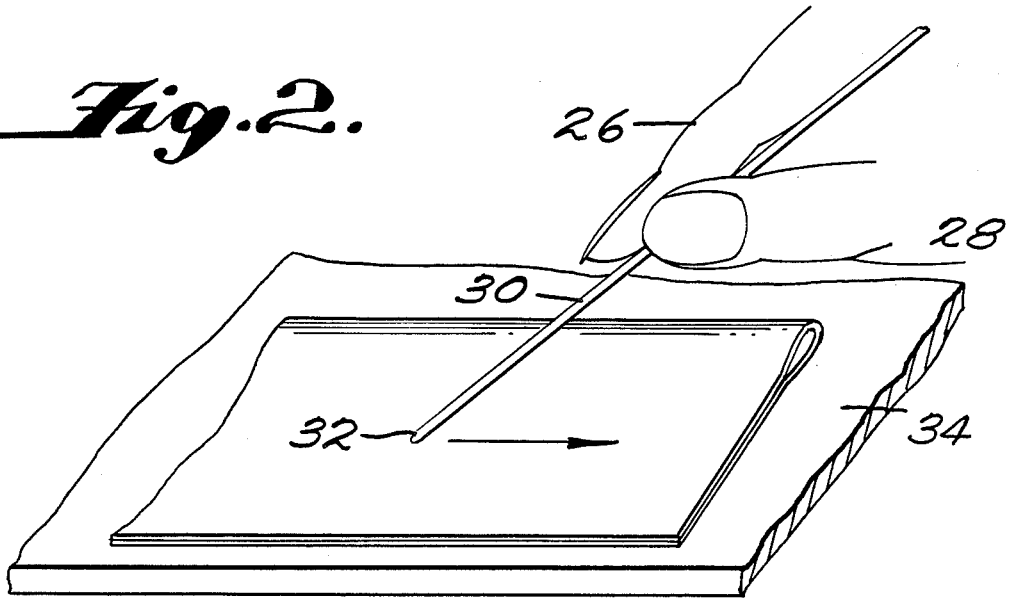
FIG. 2 shows the sheet of FIG. 1 folded over for a test.

FIG. 2 shows the manner of use of the sheet 10. Let it be supposed that sheet 10, a title document, has been presented to an official who needs to know if it is a valid original, or is an unauthorized copy. The official, whose fingers 26 and 28 are shown, folds the sheet 10 over so that area 14 will overlie and be in contact with area 18. The official will then take any sort of instrument 30 and use the end 32 to exert a pressure on the two areas—it being assumed that there is a desk top or the like 34 underneath sheet 10 to provide the reactive force. Let it be assumed that the end 32 scribes a line along the sheet 10.

Figure 3:
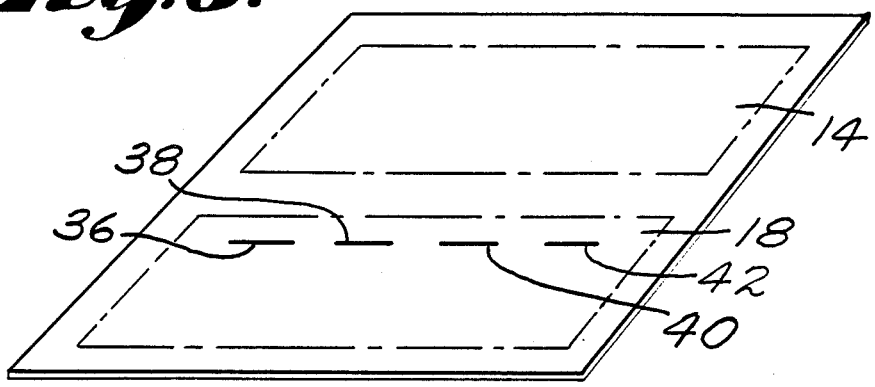
FIG. 3 shows the sheet of FIG. 2 again unfolded, with results of the test appearing thereon.

After the line is scribed the sheet 10 is then unfolded, as shown in FIG. 3, and the official inspects the area 18. If the document is valid, he will see a series of marks 36, 38, 40 and 42, which have been caused by the mixing of the first and second compositions where they have received the pressure applied through end 32 of implement 30, except, however, where the desensitized portions of area 18 exist.

The invention thusly provides two advantages. First, and unauthorized copier may have failed to note the existence of the compositions in areas 14 and 18, and did not include such on his copy. He is thereby caught in the first instance. However, even if he did not detect and use compositions, he may not have used the correct ones, and the marks such as 36 will not be of the correct color. Moreover, if the unauthorized copier did not detect the existence of the desensitized areas and fails to incorporate same in his copy, he is again given away.

As aforesaid, several pairs of compositions are known in the art to serve as the complementary compositions for areas 14 and 18. Normally these are used on the backs and fronts of documents to perform "carbonless copying". Normally one of the compositions is described as containing a dye precursor, and the other composition is described as containing a receptor. When these mix, as when capsules are ruptured, the visible marking dye results. Densentizing agents for areas 20, 22 and 24 are also well known, for example, amines and alcohols may be used. Of particular suitability would be diethylene glycol, aliphatic amines, non-pigmented printing ink, and polyvinyl alcohol. The glycols and amines chemically neutralize the dye precursor, whereas the polyvinyl alcohol or non-pigmented printing ink provide a physical barrier or coating on the receptor sheet. Many other materials may be used; however, for volume production purposes it is necessary to have materials which have the viscosity suitable for flexographic printing and a low volatility so that they do not evaporate in a short period of time.

The desensitizing agent preferably will be in a liquid form so that it may be used as ink is used in offset or other printing apparatus to be applied to the areas to be desensitized. Usually the sheet will be coated with the complementary compositions, then the information printed on the sheet over the compositions (unless only the other side is to carry the printed information) and then the desensitizing material applied.

Upon reading the foregoing description other embodiments of the invention will become apparent. Therefore, the scope of the invention is to be determined by the following claims.

What is claimed is:

1. A sheet of material having on one of its sides a first area comprising a first carbonless-copying composition and a second area comprising a second carbonless-copying composition, the compositions being of types such that when regions of the first and second areas are pressed together a visible mark will appear in the pressed region of at least one of the areas, a portion of at least one of the areas being desensitized so that no visible mark will appear as a result of the application of pressure in said portion of said area.

2. A method of detecting whether a document is a valid original or an unauthorized copy using a sheet of material as described in claim 1 including the steps of folding the sheet to place the areas where the first and second compositions would be in contact with one another in a valid original and exerting a force on the thusly plied areas to determine if a visible mark results.

3. A method of detecting whether a document is a valid original or an unauthorized copy using a sheet of material as described in claim 1 including the steps of folding the sheet to place areas where the first and second compositions would be in contact with one another in a valid original and exerting a force on the thusly plied areas to determine of a visible mark results in other than the desensitized portion.

4. A document validation system comprising a sheet of material having a coating of a first carbonless-copying composition in a first area thereof and a coating of a second carbonless-copying composition in another area thereof, the first and second carbonless-copying compositions undergoing a color-forming reaction with one another to form a visible mark in the other area when the first and other areas are pressed into contact with one another, a sub-area of the other area having a desensitizing material thereon to prevent formation of the visible mark within the sub-area.

5. The document validation system of claim 4 wherein the other area is rectangular and the sub-area comprises at least two rectangular areas spaced apart from one another within the other area.

* * * * *